US009048597B2

(12) United States Patent
Peterson et al.

(10) Patent No.: US 9,048,597 B2
(45) Date of Patent: Jun. 2, 2015

(54) STRUCTURES FOR SECURING PRINTED CIRCUIT CONNECTORS

(71) Applicant: Apple Inc., Cupertino, CA (US)

(72) Inventors: Carl R. Peterson, Santa Clara, CA (US); Alex C. Yeung, San Francisco, CA (US); Stephen R. McClure, San Francisco, CA (US); Derek W. Wright, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 180 days.

(21) Appl. No.: 13/655,734

(22) Filed: Oct. 19, 2012

(65) Prior Publication Data

US 2014/0113463 A1 Apr. 24, 2014

(51) Int. Cl.

| | |
|---|---|
| ***H01R 12/78*** | (2011.01) |
| ***H01R 12/73*** | (2011.01) |
| ***H01R 13/6581*** | (2011.01) |

(52) U.S. Cl.

CPC ..... *H01R 12/78* (2013.01); *H01R 12/73* (2013.01); *H01R 13/6581* (2013.01)

(58) Field of Classification Search

CPC ..... H01R 12/78

USPC ..... 361/785, 749, 750, 760, 782; 257/686, 257/685.686

See application file for complete search history.

(56) References Cited

U.S. PATENT DOCUMENTS

| | | | | |
|---|---|---|---|---|
| 4,774,634 | A | 9/1988 | Tate et al. | |
| 5,213,511 | A * | 5/1993 | Sobhani | 439/67 |
| 5,219,292 | A | 6/1993 | Dickirson et al. | |
| 7,506,436 | B2 | 3/2009 | Bachman | |
| 7,791,189 | B2 | 9/2010 | Zhao et al. | |
| 7,944,523 | B2 | 5/2011 | Kwak et al. | |
| 2006/0286857 | A1 * | 12/2006 | Soeta | 439/492 |
| 2011/0141052 | A1 * | 6/2011 | Bernstein et al. | 345/174 |
| 2011/0255850 | A1 * | 10/2011 | Dinh et al. | 396/176 |
| 2012/0162936 | A1 * | 6/2012 | Fujimori | 361/749 |
| 2013/0342495 | A1 * | 12/2013 | Rappoport et al. | 345/174 |

* cited by examiner

*Primary Examiner* — Jenny L Wagner
*Assistant Examiner* — Michael P McFadden
(74) *Attorney, Agent, or Firm* — Treyz Law Group; G. Victor Treyz; Joseph F. Guihan

(57) ABSTRACT

Printed circuit substrates may be formed from rigid printed circuit material or flexible sheets of polymer. Printed circuit substrates may have conductive traces. Integrated circuits, touch sensor electrode structure, sensors, and other components may be mounted to the conductive traces. Connectors such as board-to-board connectors may be used to couple printed circuit substrates together. To hold the connectors together and to provide electromagnetic shielding, printed circuits and connectors may be surrounded by printed circuit connector securing structures. The printed circuit connector securing structures may have one or more strips of conductive fabric tape wrapped around the connectors. Metal stiffening members may be attached to opposing ends of the strip of conductive tape to facilitate removal of the tape for rework or repair. An additional strip of tape may be used to help secure the wrapped conductive tape. The additional strip may have a tab to facilitate removal.

23 Claims, 10 Drawing Sheets

STRUCTURES FOR SECURING PRINTED CIRCUIT CONNECTORS

BACKGROUND

This relates generally to electronic devices and, more particularly, to electronic devices with connectors such as printed circuit connectors.

Electronic devices often include substrates such as printed circuits on which integrated circuits and other electrical components are mounted. Rigid printed circuits are formed from materials such as fiberglass-filled epoxy that are inflexible. Flexible printed circuits are formed from layers of polyimide or other sheets of flexible polymer. Integrated circuits, sensors, cameras, and other components may be mounted to pattered metal traces on rigid and flexible printed circuits.

When assembling an electronic device, it is sometimes necessary to couple substrates such as printed circuits together. For example, it may be necessary to couple a flexible printed circuit to a rigid printed circuit board or to attach a pair of flexible printed circuits to each other.

Connectors such as board-to-board connectors can be used to form printed circuit connections such as these. In a typical configuration, a first printed circuit may be provided with a first board-to-board connector and a second printed circuit may be provided with a mating second board-to-board connector. During assembly operations, the first and second board-to-board connectors may be coupled to each other. For example, a technician or a robotic assembly device may plug one of the board-to-board connectors into the other.

Electronic devices that include board-to-board connectors are sometimes subjected to drop events or other conditions that have the potential to disturb board-to-board connections. If care is not taken, a board-to-board connector may come loose, rendering an electronic device inoperable.

To address concerns with board-to-board connectors becoming loose, some manufacturers of electronic devices wrap board-to-board connectors with tape. The tape helps prevent the board-to-board connectors from coming apart during use of an electronic device, but can be difficult or impossible to replace in the event that board-to-board connectors need to be temporarily decoupled during repair operations.

It would therefore be desirable to be able to provide improved ways in which to secure board-to-board connectors.

SUMMARY

Printed circuit substrates may be formed from rigid printed circuit material or flexible sheets of polymer. Printed circuit substrates may have conductive traces. Integrated circuits, touch sensor electrode structure, sensors, and other components may be mounted to the conductive traces.

Connectors such as board-to-board connectors may be used to couple printed circuit substrates together. To hold the connectors together and to provide electromagnetic shielding, printed circuits and connectors may be surrounded by printed circuit connector securing structures.

Printed circuit connector securing structures may have one or more strips of conductive fabric tape wrapped around the connectors. Metal stiffening members may be attached to opposing ends of the strip of conductive tape to facilitate removal of the tape for rework or repair. When the conductive tape is wrapped around the connectors, the metal stiffening members may be located adjacent to each other on top of the connectors. An additional strip of tape may be used to help secure the wrapped conductive tape. The additional strip of tape may overlap the conductive tape that is wrapped around the connectors and may have a tab that facilitates removal when reworking or repairing the connector structures.

Further features, their nature and various advantages will be more apparent from the accompanying drawings and the following detailed description of the preferred embodiments.

DETAILED DESCRIPTION

Illustrative electronic devices that have coupled connectors that are held together using connector securing structures are shown in FIGS. 1, 2, 3, and 4.

Figure 1:
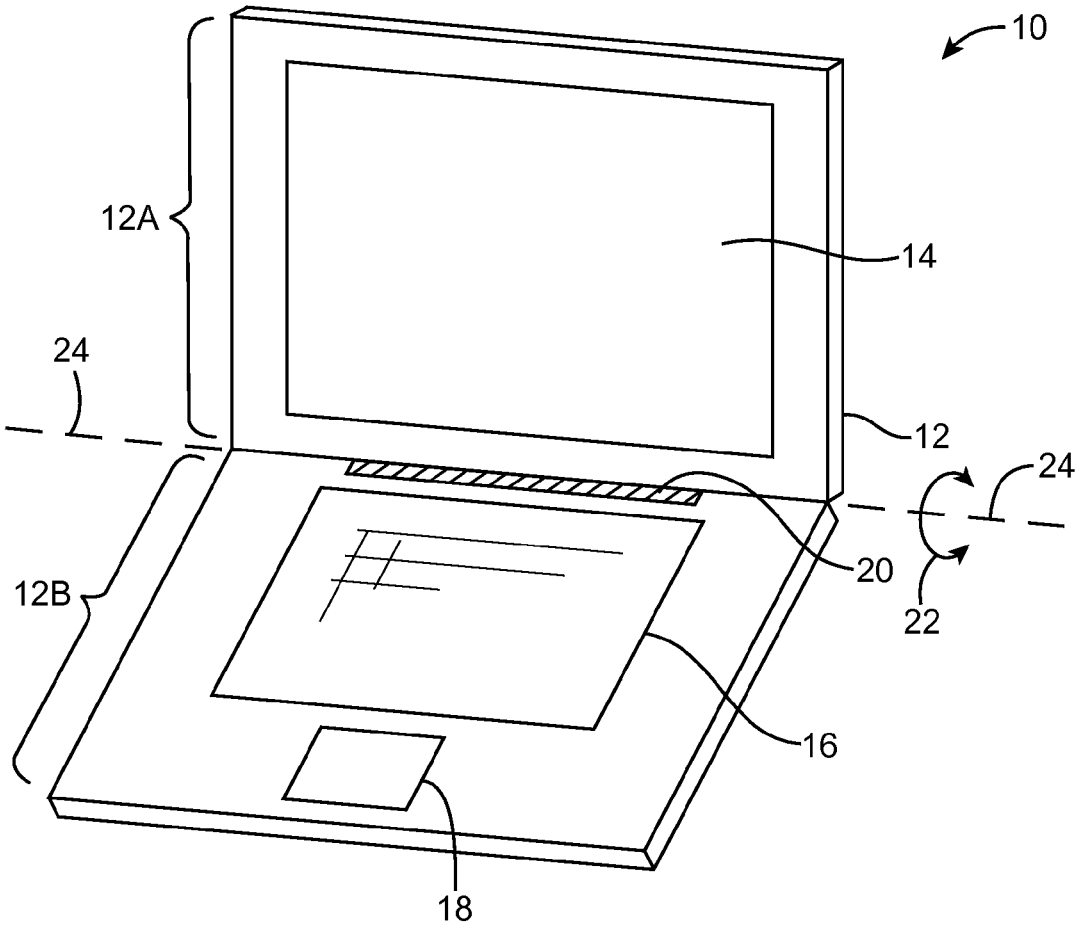
FIG. 1 is a perspective view of an illustrative electronic device such as a laptop computer with printed circuit connector securing structures in accordance with an embodiment.

Electronic device 10 of FIG. 1 has the shape of a laptop computer and has upper housing 12A and lower housing 12B with components such as keyboard 16 and touchpad 18. Device 10 has hinge structures 20 (sometimes referred to as a clutch barrel) to allow upper housing 12A to rotate in directions 22 about rotational axis 24 relative to lower housing 12B. Display 14 is mounted in upper housing 12A. Upper housing 12A, which may sometimes referred to as a display housing or lid, is placed in a closed position by rotating upper housing 12A towards lower housing 12B about rotational axis 24.

Figure 2:
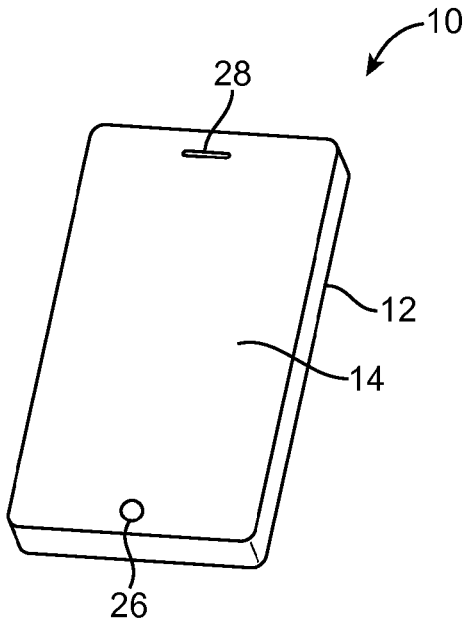
FIG. 2 is a perspective view of an illustrative electronic device such as a handheld electronic device with printed circuit connector securing structures in accordance with an embodiment.

FIG. 2 shows an illustrative configuration for electronic device 10 based on a handheld device such as a cellular telephone, music player, gaming device, navigation unit, or other compact device. In this type of configuration for device 10, housing 12 has opposing front and rear surfaces. Display 14 is mounted on a front face of housing 12. Display 14 may have an exterior layer that includes openings for components such as button 26 and speaker port 28.

Figure 3:
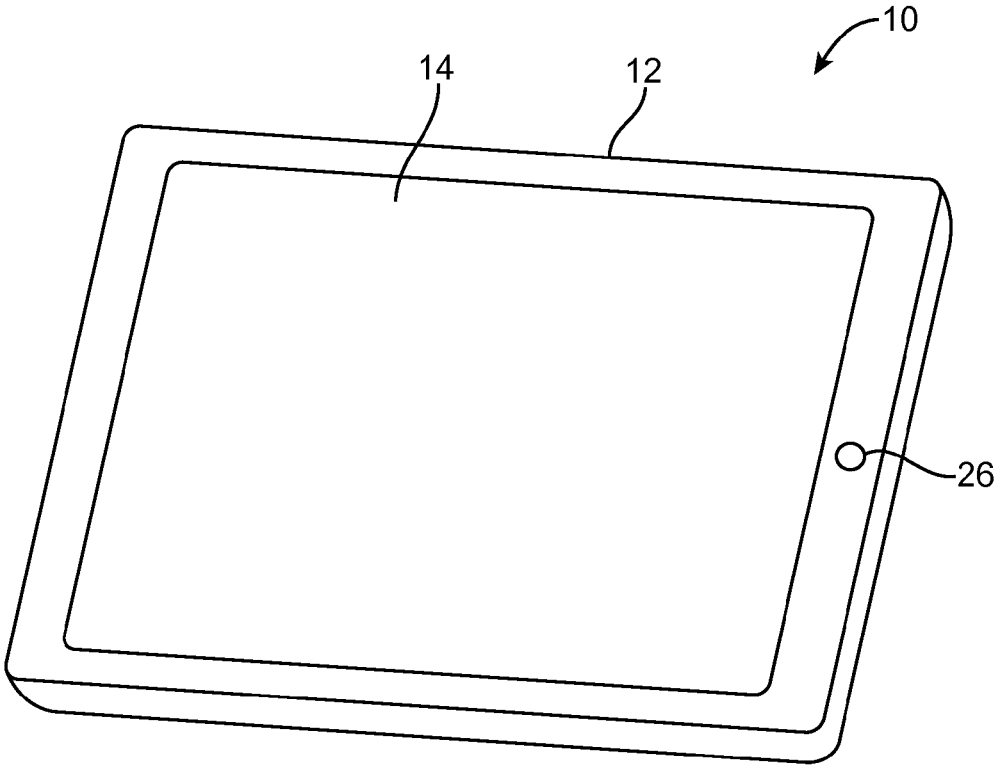
FIG. 3 is a perspective view of an illustrative electronic device such as a tablet computer with printed circuit connector securing structures in accordance with an embodiment.

In the example of FIG. 3, electronic device 10 is a tablet computer. In electronic device 10 of FIG. 3, housing 12 has opposing planar front and rear surfaces. Display 14 is mounted on the front surface of housing 12. As shown in FIG. 3, display 14 has an external layer with an opening to accommodate button 26.

Figure 4:
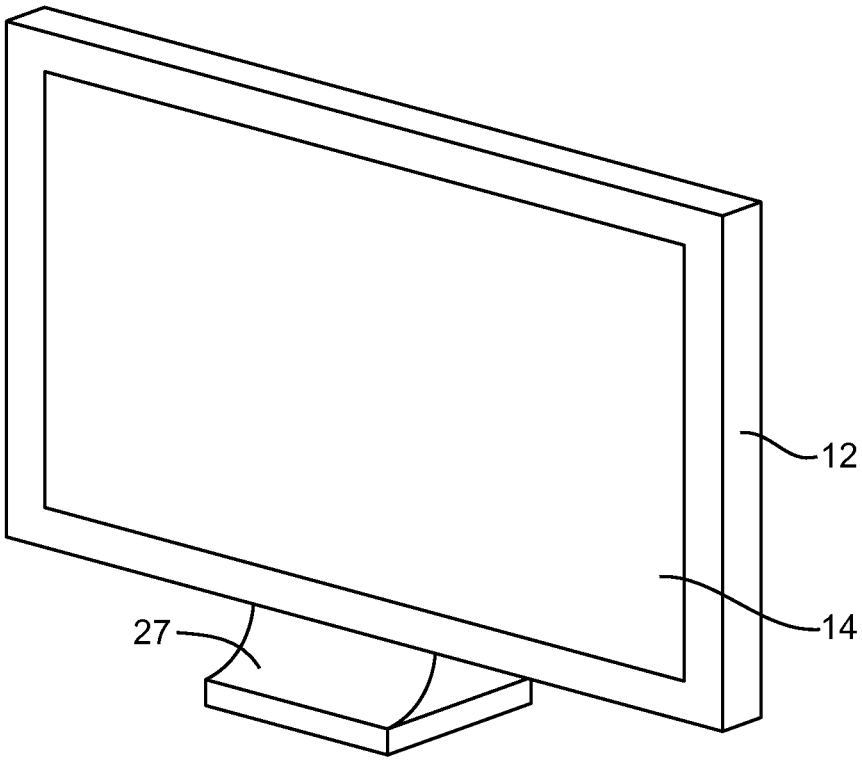
FIG. 4 is a perspective view of an illustrative electronic device such as a computer display with printed circuit connector securing structures in accordance with an embodiment.

FIG. 4 shows an illustrative configuration for electronic device 10 in which device 10 is a computer display or a computer that has been integrated into a computer display. With this type of arrangement, housing 12 for device 10 is mounted on a support structure such as stand 27. Display 14 is mounted on a front face of housing 12.

The electrical devices of FIGS. 1, 2, 3, and 4 have electrical components mounted on substrates such as printed circuit substrates. The printed circuit substrates may include rigid printed circuit board substrates such as substrates formed from fiberglass-filled epoxy and/or flexible printed circuit substrates such as substrates formed from flexible layers of polyimide or flexible sheets of other polymers. The illustrative configurations for device 10 that are shown in FIGS. 1, 2, 3, and 4 are merely illustrative. In general, electronic device 10 may be a laptop computer, a computer monitor containing an embedded computer, a tablet computer, a cellular telephone, a media player, or other handheld or portable electronic device, a smaller device such as a wrist-watch device, a pendant device, a headphone or earpiece device, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment.

Housing 12 of device 10, which is sometimes referred to as a case, is formed of materials such as plastic, glass, ceramics, carbon-fiber composites and other fiber-based composites, metal (e.g., machined aluminum, stainless steel, or other metals), other materials, or a combination of these materials. Device 10 may be formed using a unibody construction in which most or all of housing 12 is formed from a single structural element (e.g., a piece of machined metal or a piece of molded plastic) or may be formed from multiple housing structures (e.g., outer housing structures that have been mounted to internal frame elements or other internal housing structures).

Display 14 may be a touch sensitive display that includes a touch sensor or may be insensitive to touch. Touch sensors for display 14 may be formed from an array of capacitive touch sensor electrodes, a resistive touch array, touch sensor structures based on acoustic touch, optical touch, or force-based touch technologies, or other suitable touch sensor components.

Display 14 for device 10 includes display pixels formed from liquid crystal display (LCD) components or other suitable image pixel structures.

A display cover layer may cover the surface of display 14 or a display layer such as a color filter layer or other portion of a display may be used as the outermost (or nearly outermost) layer in display 14. The outermost display layer may be formed from a transparent glass sheet, a clear plastic layer, or other transparent member.

Figure 5:
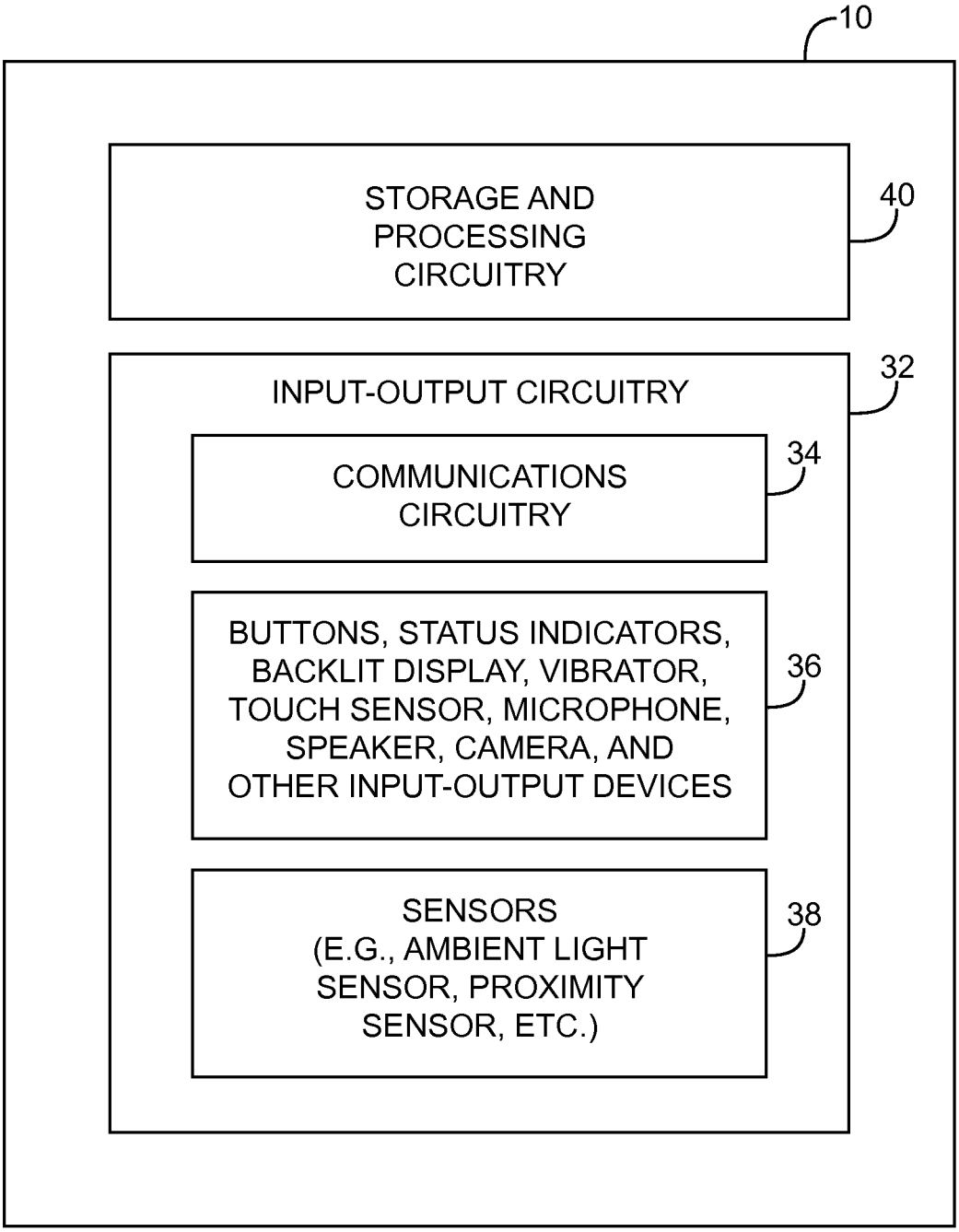
FIG. 5 is a schematic diagram of an illustrative electronic device of the type that may be provided with printed circuit connector securing structures in accordance with an embodiment.

A schematic diagram of device 10 is shown in FIG. 5. As shown in FIG. 5, electronic device 10 includes control circuitry such as storage and processing circuitry 40. Storage and processing circuitry 40 includes one or more different types of storage such as hard disk drive storage, nonvolatile memory (e.g., flash memory or other electrically-programmable-read-only memory), volatile memory (e.g., static or dynamic random-access-memory), etc. Processing circuitry in storage and processing circuitry 40 is used in controlling the operation of device 10. The processing circuitry may be based on a processor such as a microprocessor and other integrated circuits.

With one suitable arrangement, storage and processing circuitry 40 is used to run software on device 10 such as internet browsing applications, email applications, media playback applications, operating system functions, software for capturing and processing images, software for implementing functions associated with gathering and processing sensor data, etc.

Input-output circuitry 32 is used to allow data to be supplied to device 10 and to allow data to be provided from device 10 to external devices.

Input-output circuitry 32 can include wired and wireless communications circuitry 34. Communications circuitry 34 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications).

Input-output circuitry 32 of FIG. 5 includes input-output devices 36 such as buttons, joysticks, click wheels, scrolling wheels, a touch screen such as display 14, other touch sensors such as track pads or touch-sensor-based buttons, vibrators, audio components such as microphones and speakers, image capture devices such as a camera module having an image sensor and a corresponding lens system, keyboards, status-indicator lights, tone generators, key pads, and other equipment for gathering input from a user or other external source and/or generating output for a user.

Sensors 38 of FIG. 5 include an ambient light sensor for gathering information on ambient light levels. The ambient light sensor includes one or more semiconductor detectors (e.g., silicon-based detectors) or other light detection circuitry. Sensors 38 also include proximity sensor components. The proximity sensor components may include a dedicated proximity sensor and/or a proximity sensor formed from touch sensors (e.g., a portion of the capacitive touch sensor electrodes in a touch sensor array for display 14 that are otherwise used in gathering touch input for device 10). Proximity sensor components in device 10 can include capacitive proximity sensor components, infrared-light-based proximity sensor components, proximity sensor components based on acoustic signaling schemes, or other proximity sensor equipment. Sensors 38 may also include a pressure sensor, a temperature sensor, an accelerometer, a gyroscope, and other circuitry for making measurements of the environment surrounding device 10.

The substrates of device 10 contain metal traces for carrying analog and/or digital signals. Metal traces may, for example, form serial bus paths, parallel bus paths, analog signal paths, digital signal paths, etc. Some connections may be formed using solder or conductive adhesive. To permit rework and repair within device 10, it may be desirable to form at least some connections in device 10 using reusable connectors. As an example, board-to-board connectors may be used to couple a printed circuit substrate to another printed circuit substrate.

Figure 6:
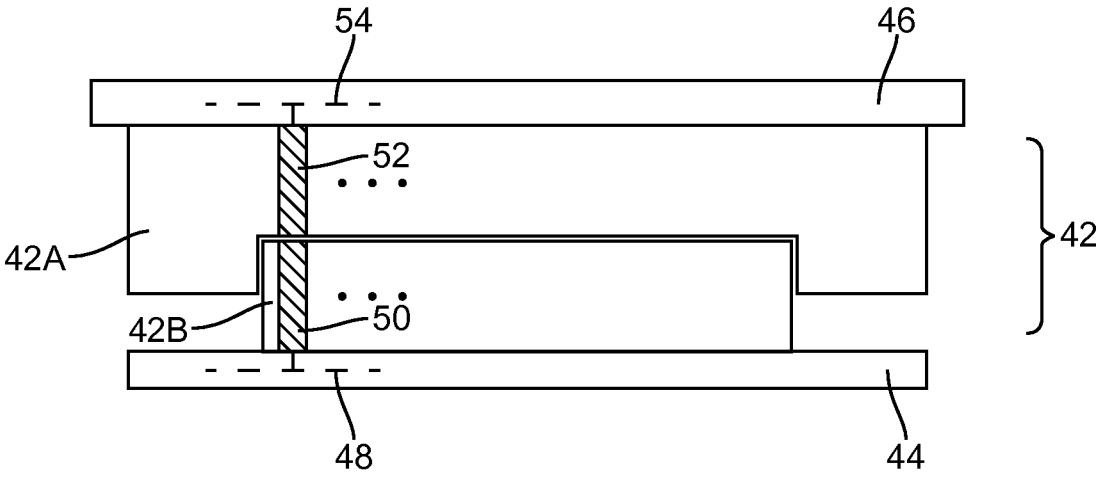
FIG. 6 is a cross-sectional view of illustrative board-to-board connector structures in accordance with an embodiment.

A cross-sectional view of a pair of board-to-board connectors is shown in FIG. 6. As shown in FIG. 6, board-to-board connector structures 42 include first connector 42A and second connector 42B. Connectors 42A and 42B mate with each other when pressed together, to form electrical connections. Connectors 42A and 42B are mounted to respective substrates. In particular, connector 42B is mounted to substrate 44 and connector 42A is mounted to substrate 46. Connectors 42A and 42B may each have contacts such as pins 50 in connector 42B and pins 52 in connector 42A. Pins 50 are soldered or otherwise electrically connected to metal traces 48 in substrate 44. Pins 52 are soldered or otherwise electrically connected to metal traces 54 in substrate 46.

Substrates 44 and 46 may be printed circuit substrates such as rigid printed circuit board substrates (e.g., substrates formed from materials such as fiberglass-filled epoxy) and/or flexible printed circuit substrates such as flexible layer of polyimide or sheets of other flexible polymers.

When a pair of board-to-board connectors such as board-to-board connector 42A and mating board-to-board connector 42B are attached to each other as shown in FIG. 6, electrical signals can pass between substrates 44 and 46. For example, analog and/or digital signals on traces 54 on printed circuit 46 can be conveyed to traces 48 on printed circuit 44 via pins 52 and 50 and analog and/or digital signals on traces 48 on printed circuit 44 can be conveyed to traces 54 on printed circuit 46.

Printed circuit connector securing structures can be used to prevent structures 42 from coming apart during use of device 10. The printed circuit connector securing structures can include conductive structures such as conductive tape. Conductive tape for the printed circuit connector securing structures may be based on conductive fabric formed from conductive metal fibers and/or plastic fibers coated with metal. When the printed circuit connector securing structures are formed from conductive materials such as conductive fabric, the printed circuit connector securing structures help ground and electromagnetically shield connector structures 42. This can help reduce radio-frequency interference from connector structures 42 that might otherwise disrupt the operation of sensitive circuitry in device 10 such as radio-frequency receiver circuitry. There can be a tendency for connector structures such as board-to-board connectors to emit radio-frequency interference, so the use of printed circuit connector securing structures to form an electromagnetic signal shield can improve device performance.

Figure 7:
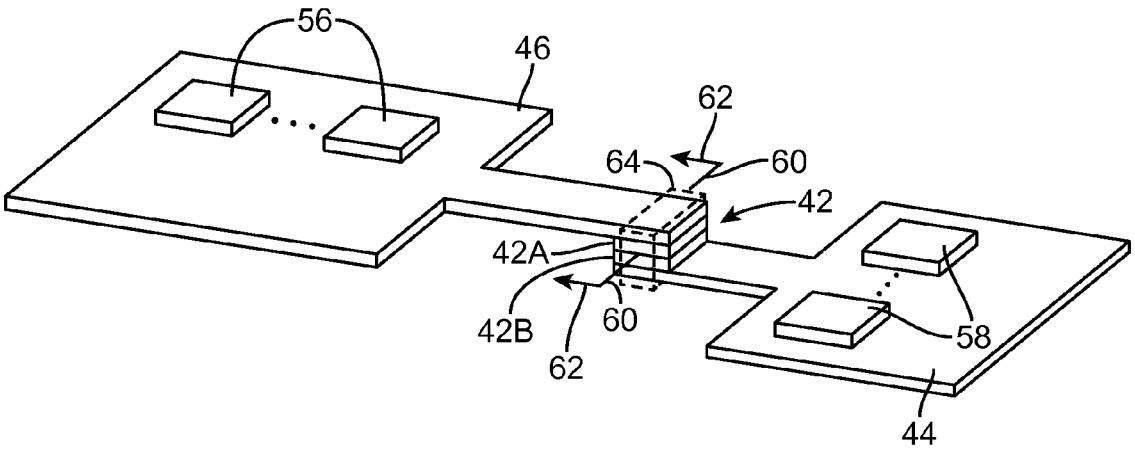
FIG. 7 is a perspective view of a pair of printed circuit structures that are being connected using a pair of mating board-to-board connectors in accordance with an embodiment.

FIG. 7 is a perspective view of a pair of illustrative printed circuits of the type that may be joined using connector structures 42. In the illustrative configuration of FIG. 7, printed circuit 46 has been provided with structure 56 and printed circuit 44 has been provided with structures 58. Structures 56 and 58 can include integrated circuits, sensors, buttons, display structures, touch sensor structures such as patterned indium tin oxide capacitive electrodes, or other components. Components such as integrated circuits and other components that have electrical contacts are mounted on printed circuit 46 using solder or conductive adhesive.

Connector structures 42 include a pair of mating connectors such as upper board-to-board connector 42A on substrate 46 and lower board-to-board connector 42B on substrate 44. Traces in substrate 46 are used to route signals between components 56 and pins in connector 42A. Traces in substrate 44 are used to route signals between components 58 and pins in connector 42B. Connectors 42A and 42B are plugged into each other during assembly of device 10. To prevent connectors 42A and 42B from becoming disconnected and to help provide electromagnetic shielding, connectors 42A and 42B are wrapped in printed circuit connector securing structures 64.

Printed circuit connector securing structures 64 include a segment of conductive tape. The conductive tape includes a layer of adhesive on a conductive metal foil or conductive fabric layer. Arrangements in which the conductive tape is formed from conductive fabric are sometimes described herein as an example.

To facilitate rework and repair, printed circuit connector securing structures 64 preferably are provided with features that facilitate the removal of the conductive fabric tape. The removal features may include, for example, stiffener members such as stiffener members formed from plastic or metal. The stiffener members may create tabs on the conductive fabric tape that can be gripped by tweezers or the fingers a technician when it is desired to remove the tape. Metal stiffener members are conductive and therefore help provide the printed circuit connector securing structures 64 with electromagnetic signal shielding capabilities. Configurations in which the stiffener members on the conductive fabric tapes are formed from metal are therefore described herein as an example.

Figure 8:
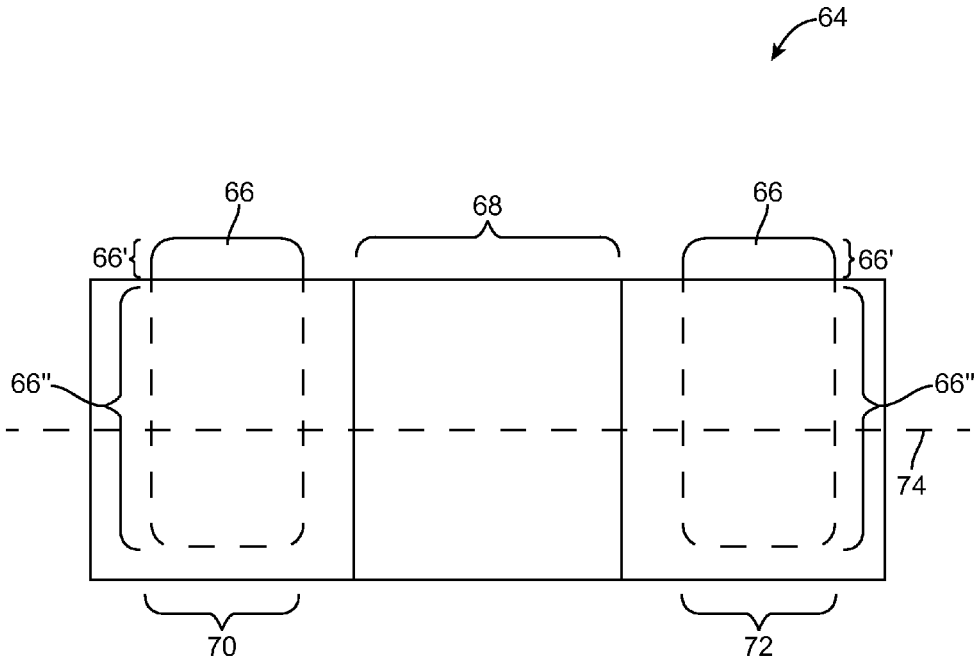
FIG. 8 is a top view of an illustrative printed circuit connector securing structure in accordance with an embodiment.

FIG. 8 is a top view of illustrative printed circuit connector securing structures 64. In the configuration shown in FIG. 8, printed circuit connector securing structures 64 are formed from a strip of conductive tape having the shape of an elongated rectangle running along longitudinal axis 74. Stiffening member 66 is located at end 70 of printed circuit connector securing structures 64. Stiffening member 66 is located at end 72 of printed circuit connector securing structures 64. Central portion 68 is interposed between ends 70 and 72 and is covered with a layer of exposed adhesive. At ends 70 and 72, portions 66' of stiffening members 66 are exposed and available to be gripped by a technician. Portions 66" are wrapped within folded over portions of conductive tape.

Figure 9:
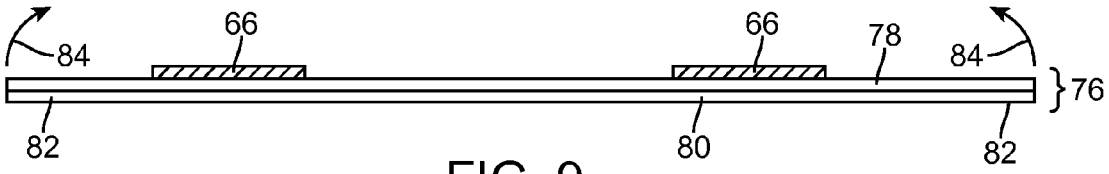
FIG. 9 is a cross-sectional view of a layer of conductive tape on which metal stiffening structures have been placed in accordance with an embodiment.

FIGS. 9, 10, 11, 12, and 13 show how printed circuit connector securing structures 64 are used to secure connector structures 42. FIG. 9 shows how stiffening members 66 are attached to conductive tape 76. Conductive tape 76 has a backing layer such as layer 80. Layer 80 is preferably formed form a conductive material such as metal. As an example, layer 80 may be formed from a thin metal foil or a conductive fabric formed from metal fibers and/or plastic fibers coated with metal. Conductive fabric configurations are sometimes described herein as an example.

Adhesive layer 78 is a layer of pressure sensitive adhesive on the surface of conductive fabric 80. As shown in FIG. 9, the process of securing connector structures in device 10 together starts by placing stiffening members 66 at different locations along the length of conductive fabric tape 76.

Figure 10:
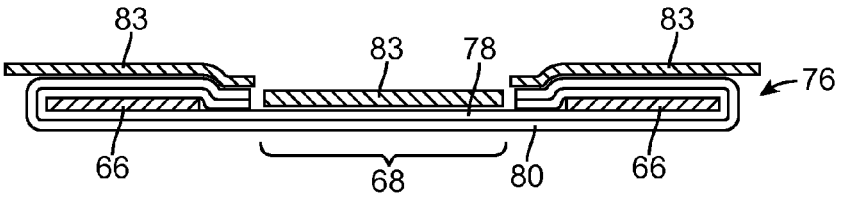
FIG. 10 is a cross-sectional side view of the conductive tape and metal stiffening structures of FIG. 9 after the tape has been wrapped around the metal stiffening structures and after release liner structures have been applied in accordance with an embodiment.

After attaching stiffening members 66 to the surface of conductive tape 76 using adhesive layer 78 as shown in FIG. 9, tips 82 of conductive tape 76 are folded over stiffening members 66 in directions 84. Release liner structures 82 are then placed on the surface of tape 76 as shown in FIG. 10. Release liner structures 82 may protect the exposed adhesive in region 68 from dust and other contaminants and may facilitate handling.

Figure 11:
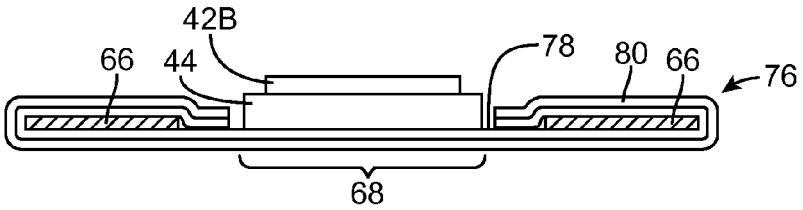
FIG. 11 is a cross-sectional side view of the conductive tape and metal stiffening structures of FIG. 11 after removal of the release liner structures and attachment of a first printed circuit and a first board-to-board connector in accordance with an embodiment.

When a technician is ready to apply the printed circuit connector securing structures to a pair of connectors, release liner structures 82 are removed and a lower connector such as connector 42B on printed circuit substrate 44 is placed on adhesive layer 78 in region 68, as shown in FIG. 11.

Figure 12:
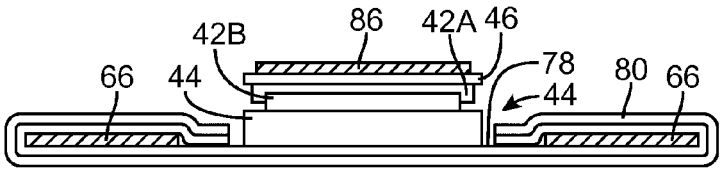
FIG. 12 is a cross-sectional side view of the structures of FIG. 11 following attachment of a second printed circuit and a second board-to-board connector that mates with the first board-to-board connector in accordance with an embodiment.

FIG. 12 is a cross-sectional side view of connector structures 42 after upper connector 42A has been plugged into lower connector 42B. Upper connector 42A is mounted to a printed circuit substrate such as flexible printed circuit substrate 46. To provide flexible printed circuit substrate 46 with localized support and stiffness in the vicinity of connector structures 42, a support member formed from a sheet of stainless steel or other metal support member 86 is attached to flexible printed circuit substrate 46 in the portion of flexible printed circuit substrate 46 that overlaps connector structures 42. A layer of adhesive is preferably interposed between sheet metal structure 86 and flexible printed circuit 46 to secure sheet metal structure 86 to flexible printed circuit 46.

Figure 13:
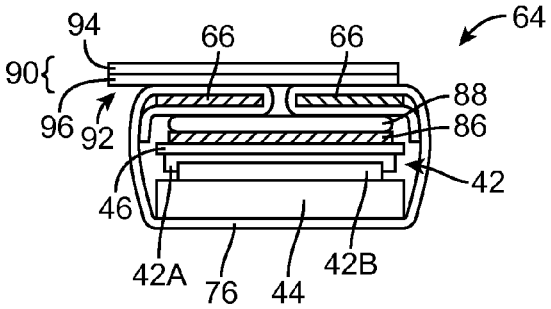
FIG. 13 is a cross-sectional side view of the structures of FIG. 12 after the ends of the conductive tape and the metal stiffening members have been wrapped around the mating first and second board-to-board connectors and after in accordance with an embodiment.

Once upper connector 42A has been connected to lower connector 42B, printed circuit securing structures 64 of FIG. 13 are used to secure and electromagnetically shield connector structures 42. As shown in FIG. 13, the end portions of tape 76 that include stiffening members 66 are wrapped around the sides and top of connector structures 42 and associated substrates 44 and 46. Stiffening members 66 are placed on the upper surface of structures 42. A layer of adhesive such as conductive adhesive 88 is placed on top of metal flexible printed circuit sheet metal stiffening structure 86 to help hold the ends of tape 76 in place.

If desired, additional tape 90 (sometimes referred to as reworking tape) can be used to further secure the ends of tape 76. Tape 90 has adhesive layer 96 on backing layer 94. Adhesive layer 96 is preferably pressure sensitive adhesive that is sufficiently weak to be removed without damaging underlying structures. Backing layer 94 of tape 90 is formed from plastic, conductive material such as metal foil or conductive fabric, or other materials. Adhesive 96 can be conductive or non-conductive.

Tab portion 92 of reworking tape 90 is formed by placing tape 90 at a location that only partly overlaps underlying structures such as tape 76, stiffeners 66, connector structures 42, and substrates 44 and 88. With this type of arrangement, tab 92 protrudes from the side of structures 64 and provides a location where a technician can grip tape 90 when it is desired to peel tape 90 off of the other printed circuit connector securing structures 64.

The presence of the wrapped conductive materials of FIG. 13 around the periphery of connector structures 42 helps to reduce electromagnetic interference. The presence of the wrapped structures also forms a mechanical supporting mechanism that prevents connectors 42A and 42B from disconnecting from each other during use of device 10. In the event that connectors 42A and 42B need to be disconnected from each other, tape 90 can be removed by a technical, connectors 42A and 42B can be taken apart, and, following repair operations for device 10, connectors 42A and 42B can be reconnected, rewrapped with tape 76, and structures 64 can again be secured using tape 90.

Figure 14:
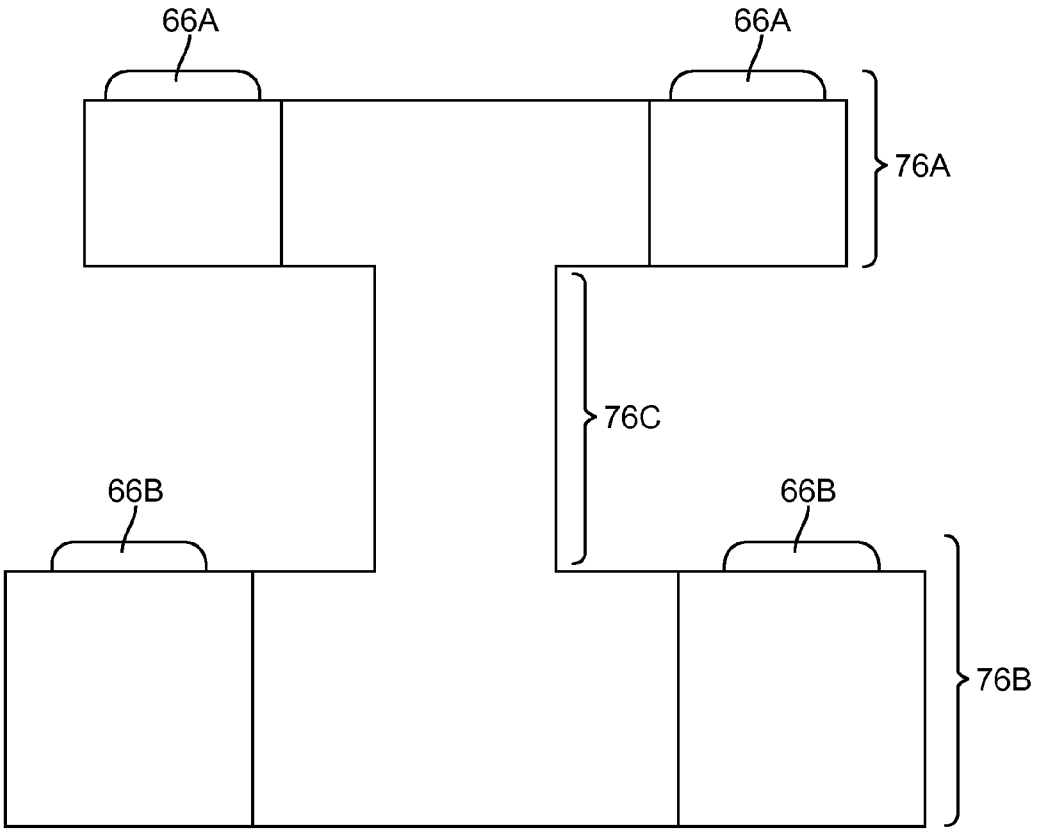
FIG. 14 is a top view of an illustrative two section printed circuit connector securing structure in accordance with an embodiment.

Printed circuit connector securing structures 64 can be provided with multiple parallel strips of tape 76 that are connected by a common spine. This type of arrangement is shown in FIG. 14. In the configuration of FIG. 14, printed circuit connector securing structures 64 have first conductive tape strip 76A with stiffening members 66A and second conductive tape strip 76B with stiffening members 66B. Spine 76C serves as a connecting structure that holds strips 76A and 76B together.

Figure 15:
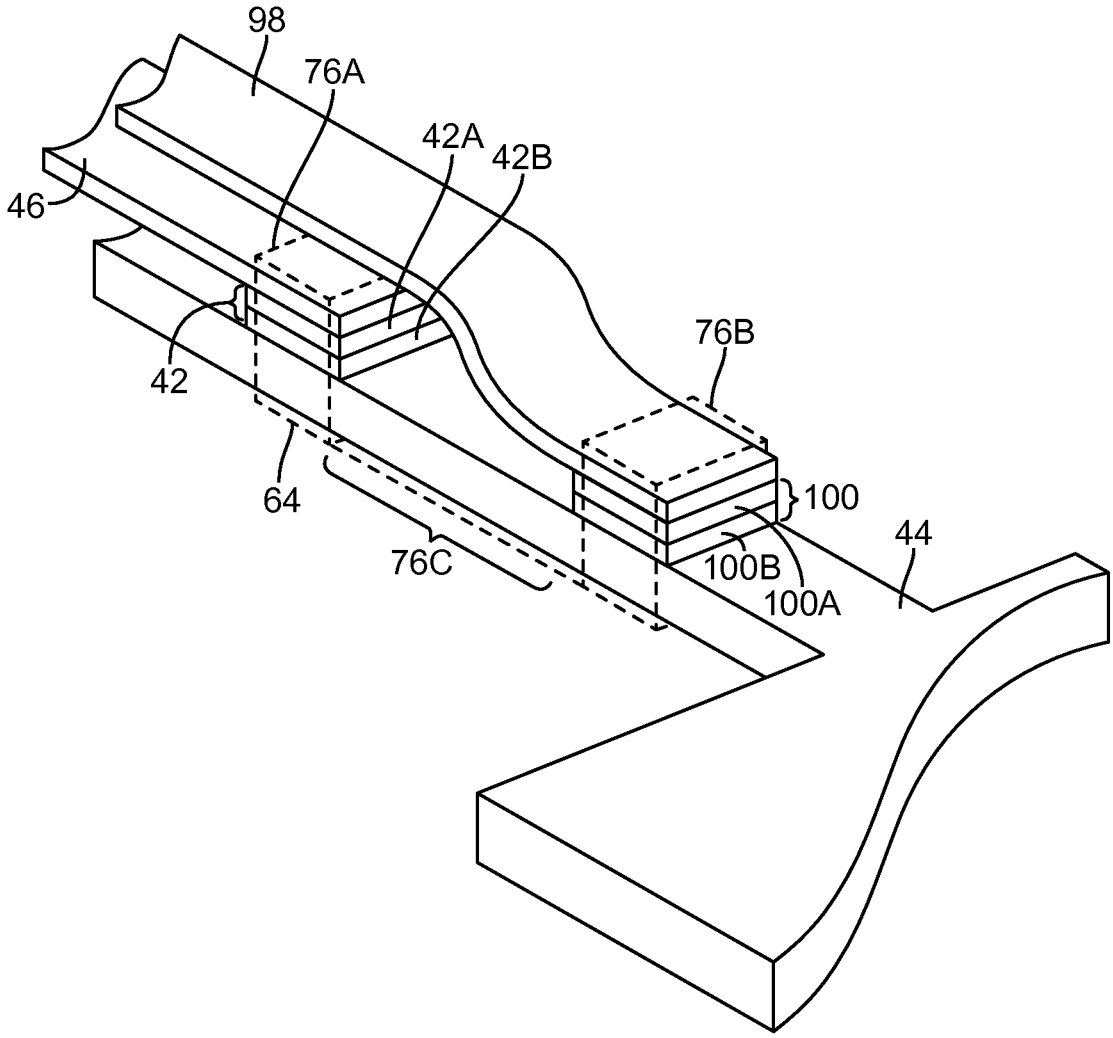
FIG. 15 is a perspective view of illustrative printed circuit structures being coupled to each other using board-to-board connectors showing how a two section printed circuit connector securing structure of the type shown in FIG. 14 can be used to secure multiple pairs of board-to-board connectors in accordance with an embodiment.

FIG. 15 is a perspective view of illustrative printed circuit structures and connectors that are being secured using a two-strip tape securing structure of the type shown in FIG. 14. In the arrangement of FIG. 15, printed circuit substrate 44 is being connected to printed circuit substrate 46 and printed circuit substrate 98. Board-to-board connector 42B and 100B are mounted on printed circuit 44. Board-to-board connector 42B mates with board-to-board connector 42A on printed circuit substrate 46. Board-to-board connector 100B mates with board-to-board connector 100A on printed circuit substrate 98. Printed circuit securing structures include two tape strips 76A and 76B, each of which is secured using a respective additional piece of tape such as reworking tape 90 of FIG. 13. Tape strip 76A wraps around connector structures 42 and tape strip 76B wraps around connector structures 100.

If desired, printed circuit connector securing structures 64 may be formed that have three or more parallel strips of tape. The configurations of FIG. 13 in which printed circuit connector securing structures 64 have a single strip of conductive fabric tape and FIG. 14 in which printed circuit connector securing structures 64 have two parallel strips of conductive fabric tape connected by a conductive fabric tape connecting structure that runs perpendicular to the parallel strips of conductive fabric tape are merely illustrative.

The foregoing is merely illustrative and various modifications can be made by those skilled in the art without departing from the scope and spirit of the described embodiments. The foregoing embodiments may be implemented individually or in any combination.

What is claimed is:

1. Apparatus, comprising:

a first printed circuit substrate;

a first connector mounted on the first printed circuit substrate;

a second printed circuit substrate;

a second connector mounted on the second printed circuit substrate that mates with the first printed circuit substrate; and printed circuit connector support structures that surround the first and second connectors and portions of the first and second printed circuit substrates, wherein the printed circuit connector support structures include tape that is wrapped around the first and second connectors and stiffening structures attached to the tape, wherein the stiffening structures include a first stiffening member attached to a first end of the tape and a second stiffening member attached to an opposing second end of the tape, and wherein an additional strip of tape is attached to both the first and second sends of the tape.

2. The apparatus defined in claim 1 wherein the tape comprises conductive fabric.

3. The apparatus defined in claim 2 wherein the first and second stiffening members are each held to the tape by a respective folded end of the tape.

4. The apparatus defined in claim 3 wherein the first and second stiffening members comprise sheet metal members.

5. The apparatus defined in claim 1 wherein the printed circuit connector support structures comprise parallel strips of the tape that are coupled by a connecting structure.

6. The apparatus defined in claim 5 wherein the parallel strips of the tape include a first conductive fabric strip and a second conductive fabric strip and wherein the connecting structure comprises conductive fabric.

7. The apparatus defined in claim 1 wherein the first printed circuit substrate comprises a flexible printed circuit substrate, the apparatus further comprising a sheet metal structure on the first printed circuit substrate.

8. The apparatus defined in claim 7 further comprising a layer of conductive adhesive on the sheet metal structure.

9. Printed circuit connector securing structures for holding together a pair of board-to-board connectors, comprising:

tape having a backing layer and an adhesive layer; and a first stiffening member that is attached to an end of the tape and a second stiffening member that is attached to an opposing end of the tape, wherein the tape is configured to wrap around the pair of board-to-board connectors so that the first and second stiffening members are adjacent to each other.

10. The printed circuit connector securing structures defined in claim 9 further comprising reworking tape that holds the ends of the tape together.

11. The printed circuit connector securing structures defined in claim 10 wherein the reworking tape comprises a protruding portion that does not overlap the board-to-board connectors.

12. The printed circuit connector securing structures defined in claim 11 wherein the ends of the tape are folded over portions of the first and second stiffening members so that parts of the first and second stiffening members protrude from the tape.

13. The printed circuit connector securing structures defined in claim 9 wherein the backing layer comprises conductive fabric.

14. Apparatus, comprising:

a first printed circuit substrate with first and second opposing sides;

a first connector mounted on the first printed circuit substrate;

a second printed circuit substrate;

a second connector mounted on the second printed circuit substrate, wherein the first and second connectors are plugged into each other;

printed circuit connector securing structures comprising conductive tape that wraps around the first and second connectors and comprising first and second metal memebers attached to the conductive tape, wherein the first and second metal members are both positioned on the first side of the first printed circuit substrate.

15. The apparatus defined in claim 14 wherein the conductive tape has a layer of adhesive and wherein the conductive tape has a portion that is folded over the first metal member so that a portion of the first metal member protrudes from the conductive tape.

16. The apparatus defined in claim 15 further comprising tape that is attached to the conductive tape to hold the conductive tape in place around the first and second connectors.

17. The apparatus defined in claim 16 further comprising:

a third printed circuit substrate;

a third connector mounted to the third printed circuit substrate; and a fourth connector mounted to the first printed circuit substrate, wherein the third and fourth connectors are plugged into each other and wherein the conductive tape has portions that surround the third and fourth connectors.

18. The apparatus defined in claim 17 wherein the conductive tape comprises first and second parallel strips of tape that are connected by a connecting portion of conductive tape, wherein the first strip of tape is wrapped around the first and second connectors and wherein the second strip of tape is wrapped around the third and fourth connectors.

19. The apparatus defined in claim 14 further comprising an integrated circuit mounted to the first printed circuit substrate.

20. The apparatus defined in claim 14 further comprising touch sensor structures on the first printed circuit substrate.

21. The apparatus defined in claim 14, wherein the first metal member is parallel to the second metal member.

22. The apparatus defined in claim 14, wherein the first metal member overlaps a first portion of the first printed circuit substrate, wherein the second metal member overlaps a second portion of the first printed circuit substrate, and wherein the first and second portions of the first printed circuit substrate are entirely different.

23. The apparatus defined in claim 7, wherein the sheet metal structure is in direct contact with the first printed circuit substrate, and wherein the first and second stiffening members overlap the sheet metal structure.

* * * * *